US006499259B1

(12) United States Patent
Hockman

(10) Patent No.: US 6,499,259 B1
(45) Date of Patent: Dec. 31, 2002

(54) NON-DEFORMING ROOF SNOW BRAKE

(76) Inventor: Mark E. Hockman, 627 E. Street Rd., Westtown, PA (US) 19395

( * ) Notice: Subject to any disclaimer, the term of this patent is extended or adjusted under 35 U.S.C. 154(b) by 0 days.

(21) Appl. No.: 09/693,786

(22) Filed: Oct. 20, 2000

Related U.S. Application Data

(60) Provisional application No. 60/160,508, filed on Oct. 20, 1999.

(51) Int. Cl.[7] ..... E04O 13/10
(52) U.S. Cl. ..... 52/26; 52/24
(58) Field of Search ..... 52/24, 26

(56) References Cited

U.S. PATENT DOCUMENTS

| | | | | | |
|---|---|---|---|---|---|
| 507,776 | A | * | 10/1893 | Berger et al. | 52/24 |
| 595,295 | A | | 12/1897 | Fox | |
| 884,850 | A | * | 4/1908 | Peter | 52/24 |
| 933,784 | A | * | 9/1909 | Peter | 52/24 |
| 1,095,822 | A | | 5/1914 | Danzer | |
| 1,330,309 | A | * | 2/1920 | Dixon | 52/24 |
| 5,222,340 | A | | 6/1993 | Bellem | |
| 5,271,194 | A | | 12/1993 | Drew | |
| 5,282,340 | A | * | 2/1994 | Cline et al. | 52/24 |
| 5,343,659 | A | | 9/1994 | Zaleski | |
| D351,989 | S | | 11/1994 | Cline | |
| 5,371,979 | A | | 12/1994 | Kwiatkowski | |
| D364,338 | S | | 11/1995 | Cline | |
| 5,483,772 | A | | 1/1996 | Haddock | |
| 5,522,185 | A | * | 6/1996 | Cline | 52/24 |
| 5,570,557 | A | | 11/1996 | Kwiatkowski | |
| 5,613,328 | A | | 3/1997 | Alley | |
| 5,664,374 | A | | 9/1997 | Lee | |
| 5,694,721 | A | | 12/1997 | Haddock | |
| 5,711,114 | A | | 1/1998 | Mueller | |
| 5,715,640 | A | | 2/1998 | Haddock | |
| 5,732,513 | A | * | 3/1998 | Alley | 52/24 X |

* cited by examiner

*Primary Examiner*—Robert Canfield
(74) *Attorney, Agent, or Firm*—Larson & Taylor PLC

(57) ABSTRACT

A one piece pad style snow guard which attaches to the vertical leg of a formed metal roof seam utilizing the formed seamed or locking portions of the seam to attach the guard without the use of penetrations or seam deformations. The guard is attached to a vertical seam by the use of threaded screws creating pressure across the slot which encloses the vertical seam. The location of the set screws intersect and lock under or into folds already in the seamed panel profile. In an alternate embodiment, a ridge located on the side of the guard opposite the locking screws and located below the lower edge of the completed folded seam runs the length of the slot. When the set screw is tightened, the entire length of the folded seam is engaged by this ridge under the folds locking the guard under the seam. This enables the guard to lock under the folded seam with out deforming the metal and lock the continuous length of the guard rather than only at the set screws, and without deforming the seam material.

7 Claims, 10 Drawing Sheets

NON-DEFORMING ROOF SNOW BRAKE

REFERENCE TO PRIOR APPLICATION

This application claims the benefit of the filing date of the applicant's Provisional Patent Application No. 60/160,508 filed Oct. 20, 1999.

BACKGROUND OF THE INVENTION

Snow brakes are used for preventing large sheets of ice or snow from sliding and falling from roofs, harming persons standing nearby or striking objects below such as shrubberies, cars or property located about the roof drip line of a building.

Typically, snow and ice accumulates on a roof until it melts or its weight causes it to fall. The snow may melt from above by warmth from the sun, or from below by warmth from the roof. Water flows through the snow and runs along the roof and drips off edges of the roof. Such water frequently causes loss of adhesion between the remaining snow and ice and the roof.

Particularly on standing seam metal roofs, or any metal roof with raised seams, the water makes the roof surface slick, causing heavy sheets of snow or ice to slide along the roof. Snow brakes are used so that the snow bank or ice sheets formed on the roof are retained until they melt or slide off the roof in small pieces. Snow brakes have been designed for attaching to the flat surface of the roof, and some snow brakes have been designed for attaching to the roof seams. Many of the snow brakes designs found in the prior art are fashioned to affix to such seams by attachment means which either puncture or deform the roofing material substantially in the operation of the device. Other snow brake devices found in the prior art are of designs which require multiple parts to function.

Multi-part snow brakes are expensive. Snow brakes which attach to the flat surface of the roof make holes through the roof and promote water entry and destruction of the roof and its supporting surface. Snow guards which use adhesives to mount to the roof can work loose from exposure to the elements, discolor the roofing materials and are not generally preferred. Snow brakes which attach to the seams of roofs can penetrate the seams or tend to deform the seams unnecessarily for locking the snow brakes on the roof. Examples of such snow brakes can be found in prior art which provides for recesses or detents in the construction of the snow brake, which are designed to accept the deformed seam.

A need exists for snow brakes which may be easily and inexpensively constructed, and which provide adequate support for snow and adequate locking to formed seams without utilizing substantial deformation of the seams as the primary anchoring point for retention of the snow brake.

DESCRIPTION OF THE PRIOR ART

U.S. Pat. No. 5,282,340 issued Feb. 1, 1994 to Cline et al. illustrates the problem with the prior art. Cline et al. suggest the use of a set screw which attaches the snow brake to a roof seam and holds it in place by deforming the opposite of the vertical portion of the roof's seam and pressing the displaced seam into a depression or dimple in the snow brake base on the opposite side of the set screw. Other patents, such as U.S. Pat. No. 5,732,513 issued to Williams on Mar. 31, 1998 continue to show deformation of a roof seam by set screws as a primary affixing means of a snow brake. In Williams, the deformation of the seam is necessary by the application of set screw pressure on both sides of a seam thereby creating opposing depressions or displacements of the roof seam sufficient to effectively hold the roof brake to a seam by causing a counter displacement immediately adjacent to a first displacement of the seam by one set screw. In effect, Williams creates opposing recesses of a roof seam by displacing the seam in the opposite direction immediately adjacent to a first displacement by a first set screw.

Such issued patents, as well as prior art patents which teach attachment means for snow brakes on existing fabricated metal roof seams do not teach the firm attachment of snow brake devices by primarily utilizing the geometry of the existing fabricated metal roof seam, whether the seam be a standing seam or a snap on seam as more fully described in the present disclosure.

SUMMARY OF THE INVENTION

The present invention provides a light weight, easily attachable, and one piece snow brake for attachment to both standing seams and snap on seams commonly used in fabricated metal roofs. The present invention uses an improved attachment means, transversely oriented to the roof seams used at the attachment point of metal roofs which are comprised of generally rectangular pieces. The described snow brake attaches through its mounting base by interlocking with the existing seam to hook the snow brake into either a standing seam or a snap on seam utilizing one or more bolts, set screws or a combination of set screws and asymmetrical base receiving structures. The present invention relies on a set screw affixed through the base of the snow brake in one embodiment, or mild deformation of the roof seam in the same embodiment depending on the side of the roof seam utilized. A reversible design, the disclose snow stop can be used either by intercepting the locking nub found on snap on seams, or hooking under the roll portion of the standing seam as more fully described in the following disclosure. The disclosed snow brake provides an improvement to the state of the art by not requiring opposing indentations, recesses or openings within the internal area of the snow brake which would receive any seam engaging fastener such a set screw.

Accordingly, it is the object of the present invention to provide a snow brake which has a simplified method of attachment of the brake to a seam in a metal roof which utilizes a folded seam or existing radius pre-formed in the seam for attachment.

It is further the object of the invention to provide a snow guard in which the attachment does not rely on a depression or a recess in the snow guard base which is used to compliment the depression formed by the snow guard attachment means in the seam being displaced by the attachment means.

It is further an object of the present invention to provide a roof snow guard which is symmetrical in design such as to allow the guard to be useable and functional when rotated 180 degrees on its longitudinal axis. In furtherance of such object, the disclosed snow guard provides a 90 degree angle from the base of the snow guard to the snow plate of the snow guard thereby allowing the rotation of the snow guard to match a given roof seam alignment whether the seam is to the left or right of the seam.

The novel features that are considered characteristic of the invention are set forth below in the disclosure, and with particularity in the claims appended hereto. The invention itself, both as to its construction and its method of operation, together with additional objects and advantages thereof, will best be understood from the description of specific embodiments which follows when read in conjunction with the accompanying drawings, wherein like numbers refer to like parts. These, and many other objects will become readily apparent to those skilled in the art of making snow brakes, upon reading the following detailed descriptions which disclose specific embodiments which best present the invention.

BRIEF DESCRIPTION OF THE DRAWINGS

FIG. 1 (*a*) is an additional embodiment of the snow brake showing a non-reversible version of the brake with the snow plate placed at one end of the base.

DETAILED DESCRIPTION OF THE PREFERRED EMBODIMENT

Figure 1:
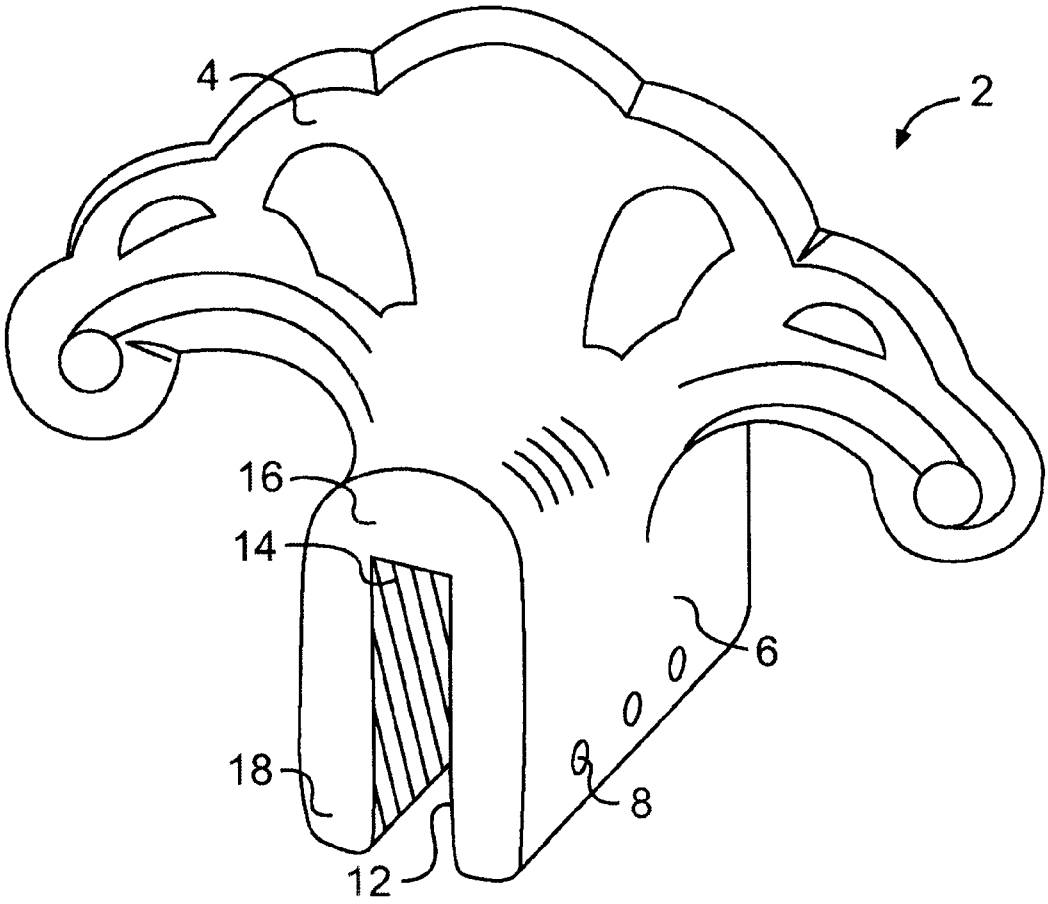
FIG. 1 is a perspective view of one embodiment of the present invention illustrating the entire snow brake in the first configuration.
Figure 1A:
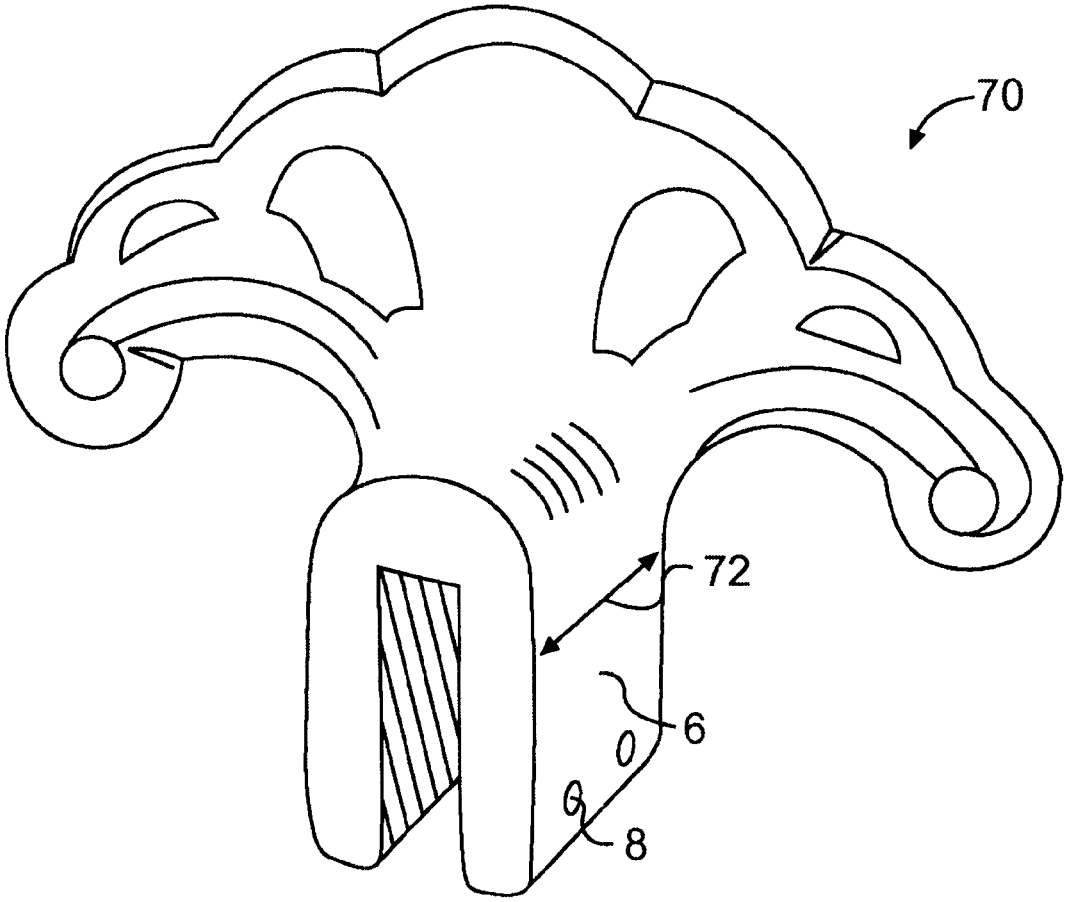

Reference will now be made to the various Figures wherein like numbers represent like parts. Referring to FIG. 1, an embodiment of the snow brake is generally indicated by the numeral 2. The present invention has several parts which include the snow plate 4, the snow brake base 6, screw receiving slots 8, base set screws 10 which operate and are inserted through screw receiving slots 8, and the U shaped seam receiver 12 which includes a top and bottom. The top of seam receiver 12 is the receiver head 15. Snow guard 2 operates in a conventional fashion in that it prevents the movement of snow and ice upon a roof by contacting a sliding snow or ice mass, thereby interfering with downward movement of the mass. Snow plate 4 normally contacts snow or ice sliding downward off a sloping roof. Snow or ice contacts snow plate 4 in a generally normal direction thereby transmitting such force through plate 4 to base 6, which is an integral part of the one piece design illustrated in FIG. 1. Such force is thereby transmitted through the base 6 to set screws 10 more fully illustrated in FIGS. 4 through 8. Set screw 10 is inserted in screw receiving slots 8 as shown generally in FIG. 1. When inserted sufficiently deep through slot 8, it will be appreciated that screw 10 will contact whatever material is situated Within the U shaped seam receiver 12. Therefore, any force being applied to snow plate 4 is translated into base 6 and the resulting force is transmitted to whatever material set screw 10 is contacting with seam receiver 12. In normal operation, snow guard 2 is situated on a vertically extending roof seam by the set screw friction, thereby preventing movement of snow guard 2 along the seam when the guard is firmly attached as will be more fully described below.

One advantage of the present invention is that the snow brake design disclosed may be produced in a reversible design as disclosed in FIG. 1, or a non reversible design as shown in FIG. 1 (*a*). As can be seen by comparison of the figures, the nonreversible snow brake in FIG. 1 (*a*) is designed generally similar to the symmetrical and reversible design of FIG. 1 except that snow plate 4 is located at the extreme of longitudinal dimension 72 when measured across the longitudinal axis of base 6. Therefore, the disclosed invention in FIG. 1 (*a*) can be only in one direction when straddling a given roof seam. Since the invention only has screw receiving slots 8 generally on one side of base 6, two different models, left hand or right hand versions of the brake are desirable when slot 8 is located only on one side of base 6. However it is possible to utilize the invention by using only one model of the nonreversible brake 70 by using the set screw 10 on the same side of a given roof seam regardless of the orientation of roof standing seam roll joint 34. Whether rolled on the left side or right side of a given seam, application of the set screw as described below will still allow the brake to be fixed to the seam without regard to whether the roll is on the left hand side or the right hand side as described below.

Figure 5:
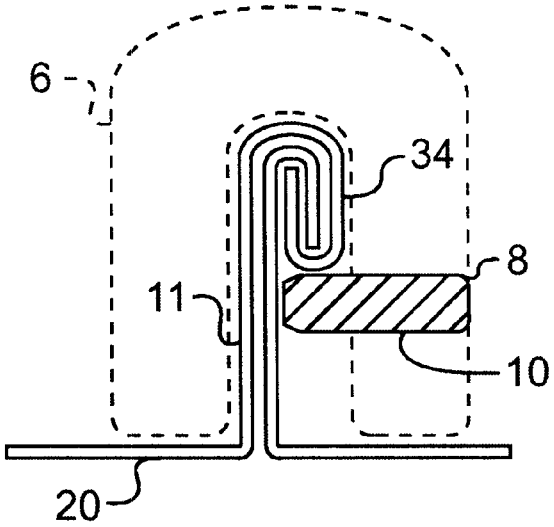
FIG. 5 is a ghosted end view of the snow brake seam receiver seated over a standing seam of a typical metal roof.
Figure 6:
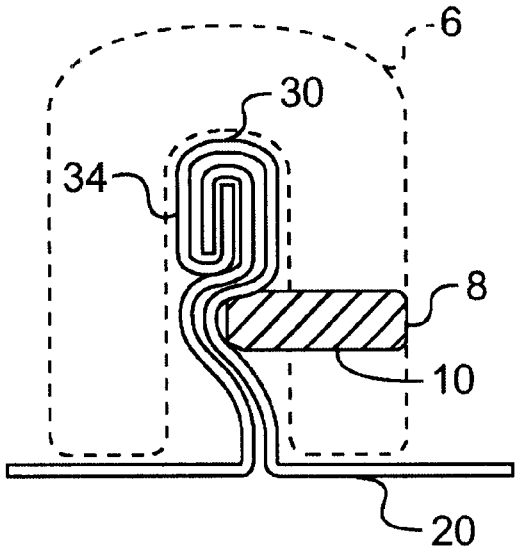
FIG. 6 is a ghosted end view of the snow brake seam receiver seated over a standing seam of a typical metal roof showing the disclosed snow brake reversed 180 degrees from the position illustrated in FIG. 5.
Figure 7:
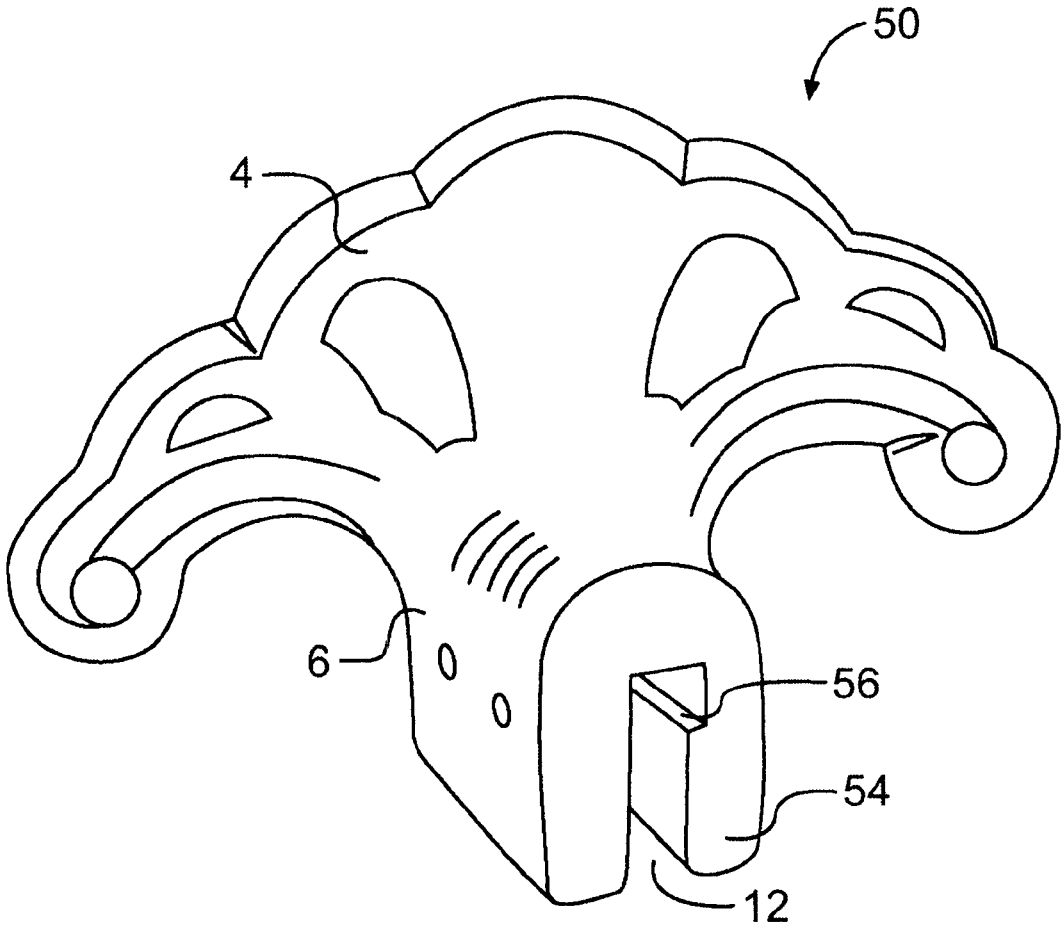
FIG. 7 is a perspective view of the snow brake showing a second embodiment with an asymmetrical seam receiver slot.
Figure 8:
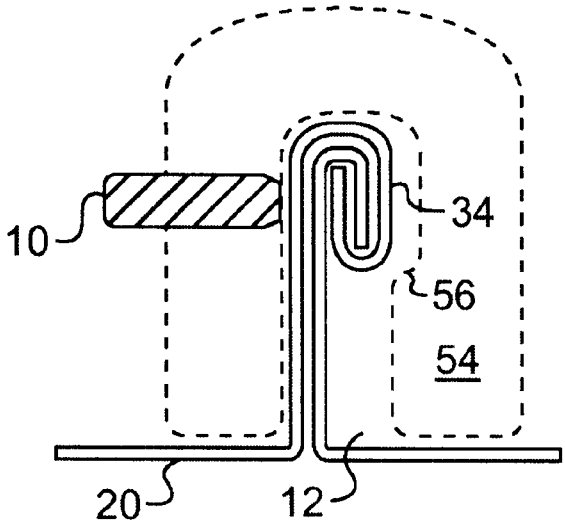
FIG. 8 is a ghosted view illustrating the snow brake seam receiver over a schematic illustration of the end of a standing seam illustrating positioning of the asymmetrical seam receiver locking the snow brake to the folded seam without using set depressions of the seam.

Metal roofs are formed from an array of separate roof panels which interconnect along their lateral edges by what are generally referred to as standing seams. Whether formed on the site by automatic machinery or forming brakes, the standing seams are one of the most commonly found attachment means for connecting adjacent roofing panels. Roof seams are formed by rolling the edges in a fashion which provides for a watertight and secure joint. FIGS. 5 and 6 illustrate a roof panel standing seam 30 as shown in the various figures. Roofing material 20 is attached together using well known procedures to create such a joint. The present invention takes advantage of the asymmetrical shape of the roll joint 30 shown in FIGS. 5 and 6 by utilizing the roll joint head 34 to lock snow brake plate 6 in position, utilizing set screw 10. Using the very same snow brake 2, the show brake can operate in two different ways depending on whether it is placed with a set screw on one side or the other of the asymmetrical roll joint 34.

Turning to FIG. 5, it will be appreciated that set screw 10 protrudes under the roll joint head 34 when inserted through snow brake base 6 through screw receiving slots 8. In the configuration of the snow brake as shown in FIG. 5, it is not necessary that set screw 10 deform standing seam 30 when the set screw engages the vertical portion of the roof standing seam as, more fully illustrated in FIG. 5. It is not necessary that brake base 6 contain a deformation, dimple, receiving slot or any type of recess to receive a deformed portion of the roof seam at point 11 which may be bent under any pressure being exerted by the travel of set screw 10. Snow guard 2 remains in place on the roof seam because of the interference that the standing seam roll joint 34 provides to any movement of brake base 6 once the set screw is engaged. Returning to FIG. 1, it can be seen that the snow brake has multiple receiving slots 8 so that more than one set screw 10 may be placed to underride the roof standing seam head 34 to assure locking engagement.

Since snow guard 2 of FIG. 1 is of a symmetrical design, allowing the guard to be installed in either direction without regard to a preferred side of the snow plate 4, it can be seen that installation of snow guard 2 might be such as to cause the orientation of the brake base 6 to be reversed, as fully illustrated in FIG. 6. In such a case, the snow brake still functions normally in that there is depression and bending of roof standing seam 30 as shown in the illustration. The engagement of set screw 10 also sets deformation because the limited width of the seam receiver 12 will cause the seam roll joint 34 to limit the travel of brake base 6 as the set screw is engaged as shown in FIG. 6. Upward travel of base 6 is limited because of the interference of the roll joint 34 creates as being thereby located directly above the depression point of the set screw as fully engaged. In this embodiment as disclosed, it is not necessary that there be a depression, receiving dimple or other recess in the brake base 6 to receive the deformation of the standing seam. Such extended deformation of the seam is not necessary for base 6 to be securely engaged to the seam.

Figure 4:
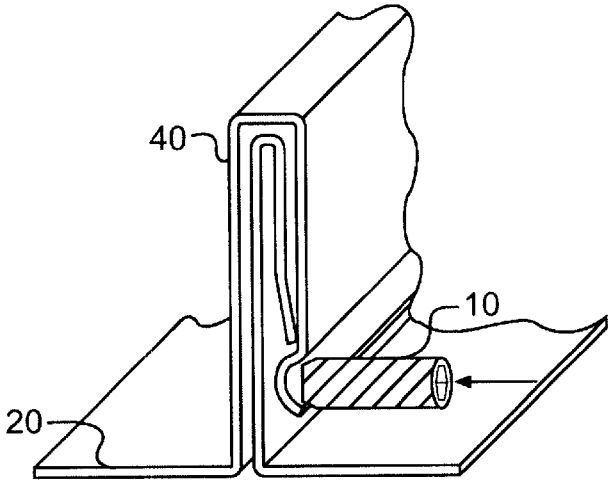
FIG. 4 is a perspective view of a snap on roof seam illustrating the engagement of a set screw into a typical seam locking nub.

Another use for the disclosed invention is on the type of roof seam that has a ledge along the bottom edge of the seam which engages the opening of the seam where the two sides of roof panel 20 meet. A prospective view of such a seam is shown in FIG. 4, where it can be appreciated that the seam is similar in some aspects of the standing seam shown in FIGS. 5 and 6. However, the second style seam, known as a snap on seam, has a ridge like structure used to assist in the locking of the two edges of the roof plates 20 referred to herein as a locking nub shown at 42. Without the application of any external fasteners, it can be appreciated from the diagram as shown in both FIGS. 2 and 4 that snap on seam 40 locks into place by the spring like engagement of the two folded panel parts where the seams meet. The present invention takes advantage of this particular aspect of the seam by being designed to provide the engagement of set screw 10 into nub 42 thereby securing the seating of set screw 10 and also urging tighter fit of snap on seam 40 by the compression of one edge of the seam with the internal bend of the second panel meeting the nub as shown. This configuration does not compress or deform the seam in the center, but rather applies such compression at the portion of the seam closest to the roof and below the point where the ends of the roof panels meet.

Figure 3:
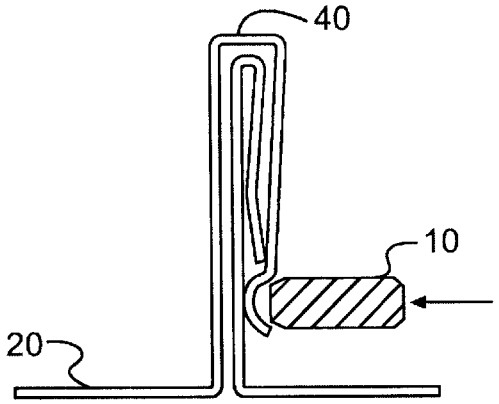
FIG. 3 is a schematic end view similar to FIG. 2 but showing the set screw in a seated position.
Figure 9:
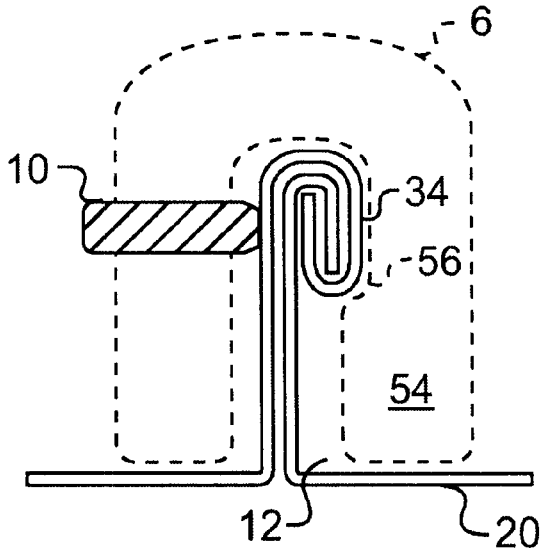
FIG. 9 is a ghosted view illustrating the snow brake seam receiver over a schematic illustration of the end of a standing seam illustrating positioning of the asymmetrical seam receiver illustrating the snow brake base in the locked position.
Figure 10:
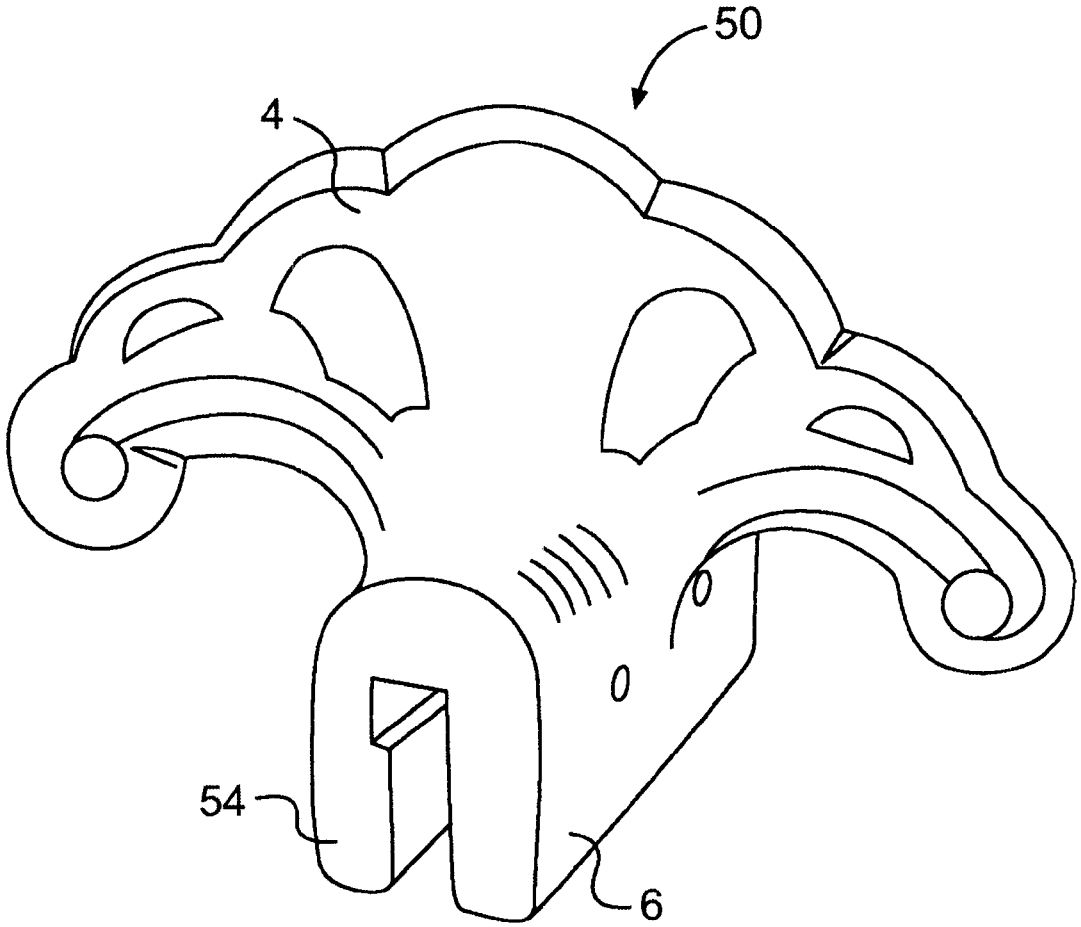
FIG. 10 is a perspective view of another embodiment of the reversible snow brake showing an asymmetrical receiver.
Figure 11:
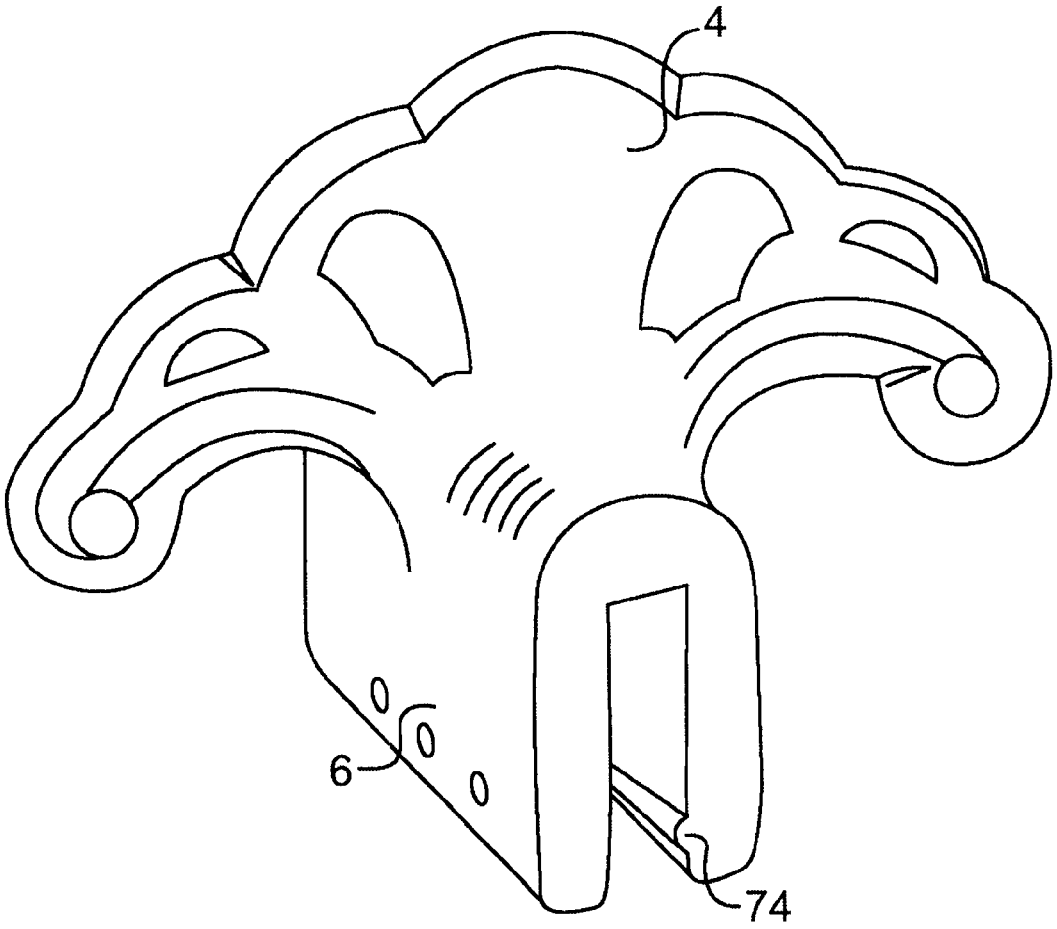
FIG. 11 is a perspective view of an asymmetrical snow brake illustrating the modified nub indentation receiver.
Figure 12:
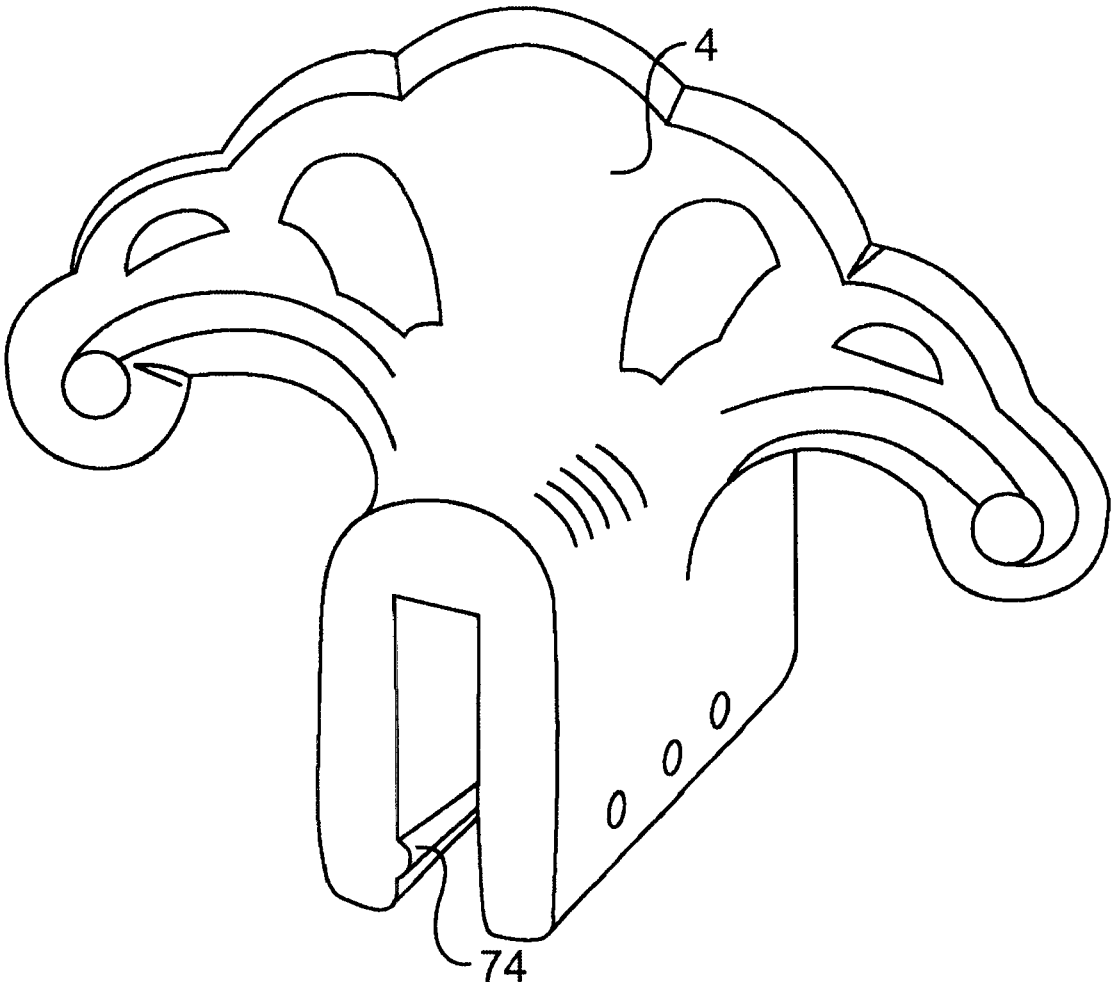
FIG. 12 is a perspective view of the snow brake illustrating an asymmetrical nub receiver used and configured when the snow brake is reversed.
Figure 13:
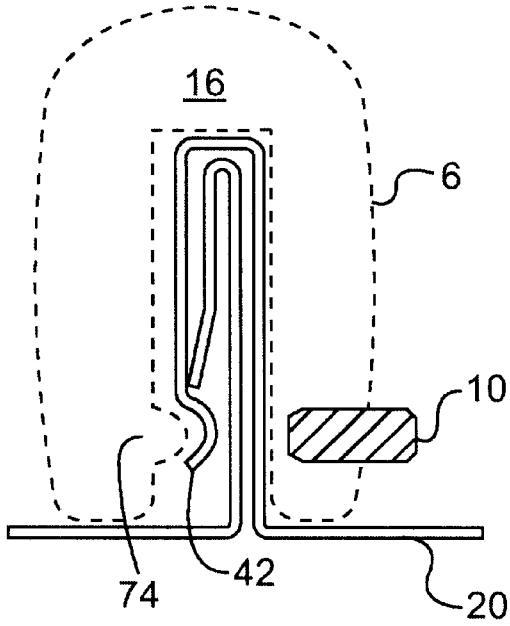
FIG. 13 is a schematic end view of one embodiment of the snow brake illustrating the brake placed over a snap-on roof seam.

FIG. 3 illustrates this process whereby snow guard 2 is not shown for the purpose of clarity. Set screw 10 is illustrated in the fully compressed position having the advantage of urging a tighter seal in this seam configuration. An,alternative embodiment of the present invention can be seen in FIG. 7 whereby snow guard 50 is shown with a modified seam receiver 12. As can be seen, this seam receiver 12 is not rectangular as shown in the first embodiment of the snow guard illustrated in FIG. 1. Snow guard 50 offers the ability to use the asymmetrical profile of a roof standing seam 30 by presenting an asymmetrical seam receiver foot 54 which, serves to hook under the standing seam roll joint 34 as shown. Roll joint 34 contacts receiver foot 54 at receiver foot ridge 56 illustrated in FIG. 8 and FIG. 9. It can be appreciated by considering the cross sectional view shown that upon insertion of set screw 10 and the tightening of set screw 10 against standing seam 30, foot 54 will be urged inward to present foot ridge 56 in a position to cause a locking effect of snow brake base 6 in relation to the roof standing seam as shown. As with the first embodiment illustrated above, the second embodiment does not require a recess or depression for receiving any portion of a deformed or bent roof seam. However, the embodiment set forth in FIG. 8 and FIG. 9 does require that snow guard 50 be oriented such that receiver foot 54 is presented under the standing seam roll joint 34 for the disclosed embodiment to function properly. In order to accommodate the problem of not knowing in advance the left hand or right hand orientation of the screw seam roll joint 34, either two versions (left hand or right hand) of snow brake 50 in FIG. 7 can be produced, presenting a mirror image of FIG. 7 to accommodate the different direction of the seam, or a reversible version of snow brake 50 with the asymmetrical base 6 can be produced as shown in the FIG. 10. It will be appreciated that by having the snow plate 4 located in the longitudinal center of and perpendicular to base 6 as shown in FIG. 10, it is possible to simply reverse the snow brake so that the asymmetrical seam receiver foot 54 appears on the proper side of the standing seam 30. Whether reversible versions of snow brake 50 are used, or the left hand or right hand version as suggested in FIG. 7, will be up to the discretion of the user or the simplicity desired in the manufacturing process. It will be appreciated by one skilled in the art that the function of the snow brake shown in FIG. 7 and in FIG. 10 are essentially the same with respect to the locking mechanism and the orientation of base 6 with the roof standing seam roll joint 34.

Figure 2:
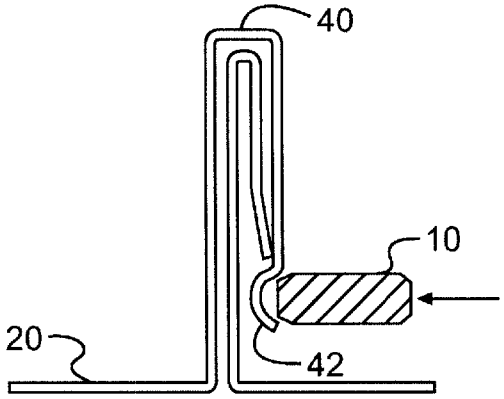
FIG. 2 is a schematic view of one end of a typical snap on roof seam illustrating the alignment of the set screw fastening means to a radius preformed in the seam locking groove.
Figure 14:
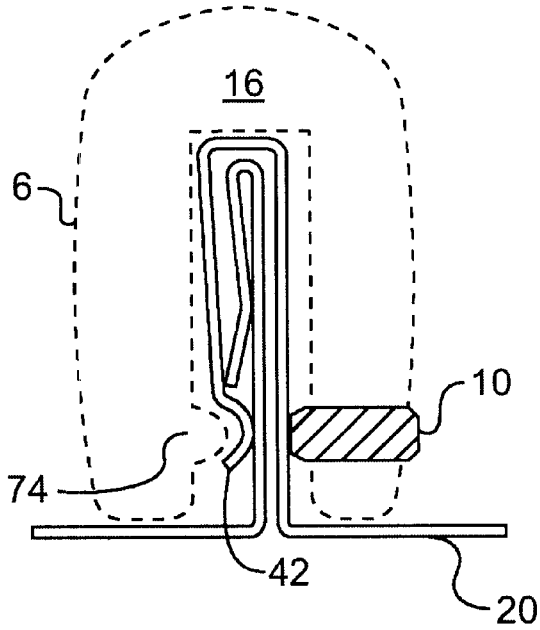
FIG. 14 is a schematic end view of the base of a snow brake with the asymmetrical nub receiver in the attached position.

Turning now to FIGS. 11, 12, 13 and 14, yet another embodiment of the present invention will be described. FIGS. 2, 3, and 4 describe the attachment of a symmetrical and reversible snow brake, as shown in FIG. 1, to a snap-on seam as illustrated. Much in the same way that the asymmetrical seam receiver described in FIG. 7 fits the orientation of the roll joint in the standing seam, it is likewise possible to enhance and improve the attachment mechanism for a snow brake by fitting the internal area and shape of snow brake base 6 to fit the detent or groove and ridge illustrated in FIGS. 2, 3, and 4 on the snap-on seam design. In considering the end view shown in FIGS. 13 and 14, it can be seen how a properly shaped snow brake base with an elongated ridge or dimple design 74 as shown in the perspective view of FIG. 12, can fit neatly within the detent or groove used on the snap-on seam. When sliding the snow brake down, in position on top of a given snap-on roof seam, by having the ridge on the interior of the base 6 properly located, the ridge will mate with the indentation in the groove of the seam as suggested by FIG. 13. When tightening set screw 10, FIG. 14 shows how base 6 will be drawn closer to the seam, whereby the ridge 74 will be urged into the detent or, nub 42 as illustrated. This provides the advantages described above where the set screw 10 fits into nub 42. However, with the embodiment of the invention described and illustrated in FIGS. 12 through 14, it can be seen that additional stability and improvement of the attachment means can be achieved by the proper shaping and sizing of ridge 74 as illustrated.

It can be appreciated from the foregoing description and various embodiments provided that numerous changes or modifications may be made without the department from the spirit or the scope of the invention as defined by the following claims. Although certain preferred embodiments are presented for the purpose of describing the applications of the present invention, other species or derivations from the thrust of the invention presented are considered within the scope of the invention.

What is claimed is:

1. In the combination of a snow brake and seam of a metal roof, an inverted, rectangular, U-shaped base having a central slot receiving a folded seam of a metal roof, said seam including a locking nub depression along said seam, said base having first and second sides extending along the slot and a curved top interconnecting the sides, the first side having fastener-receiving openings receiving roof seam-engaging fasteners, a snow plate extending upward from said base, the snow plate having a surface portion extending laterally beyond the sides of the base, and lower, inner sections of the plate connected to said first and second sides, respectively, for supporting the sides with the snow plate and for preventing relative outward movement of the sides when engaging the roof seam, the improvement comprising locating said fastener-receiving openings to align said seam engaging fasteners in said locking groove depression along said roof seam.

2. In the combination of a snow brake and a snap-on style of roof seam including a locking groove depression along the length of such seam, said snow brake comprising an inverted, rectangular, U-shaped base having a central slot receiving a folded seam of a metal roof, first and second sides extending along the slot and a top interconnecting the sides, the first side having fastener-receiving openings receiving seam-engaging fasteners, a snow plate extending upward from the base, the snow plate having a surface portion extending laterally beyond the sides of the, base, and lower, inner sections of the plate connected to the first and second sides, respectively, for supporting the snow plate and for preventing relative outward movement of the sides when engaging the roof seam, the improvement wherein the fastener-receiving openings are located to align the fasteners in said openings with said locking groove depression of said seam.

3. A snow brake comprising a base with a bottom and a top, the base having a longitudinally extending body with first and second longitudinal ends, a slot extending upward from the bottom toward the top and terminating spaced from the top and extending through the first and second ends for receiving a folded seam of a metal roof in the slot, the slot dividing the base into first and second opposite sides connected at the top said first side having holes extending transversely through the side for receiving and holding anchor screws, a snow brake plate connected to the base and extending laterally beyond the opposite sides of the base and extending upward to beyond the top of the base and having lateral portions extending outward from the opposite sides of the base and near a bottom of the plate, wherein further said second opposite side of said base contains a ridge located to protrude below the lowest portion of a rolled roof seam.

4. The snow brake of claim 2 wherein further the said snow brake plate is located substantially at one end of said longitudinally extending body.

5. A snow brake comprising a base with a bottom and a top, the base having a longitudinally extending body with first and second longitudinal ends, a slot extending upward from the bottom toward the top and terminating spaced from the top and extending through the first and second ends for receiving a folded seam of a metal roof in the slot, the slot dividing the base into first and second opposite sides connected at the top, said first side having holes extending transversely through the side for receiving and holding anchor screws, a snow brake plate connected to the base and extending laterally beyond the opposite sides of the base and extending upward to beyond the top of the base and having lateral portions extending outward from the opposite sides of the base and near a bottom of the plate, wherein further said second opposite side of said base contains a ridge located to protrude into the snap on seam locking groove of a snap on roof seam.

6. A snow brake comprising a base with a bottom and a top, the base having a longitudinally extending body with first and second longitudinal ends, a slot extending upward from the bottom toward the top and terminating spaced from the top and extending through the first and second ends for receiving a folded seam of a metal roof in the slot, the slot dividing the base into first and second opposite sides connected at the top, at least one side having holes extending transversely through it for receiving and holding anchor screws such as to allow the snow brake to be reversible with respect to its orientation on said folded seam, a snow brake plate connected to and perpendicular to the base and extending laterally beyond the opposite sides of the base and extending upward to beyond the top of the base and having lateral portions extending outward from the opposite sides of the base, said holes for said anchor screws being located on opposite sides of said snow brake plate whereby said snow brake is reversible on said folded seam.

7. A snow brake comprising a base with a bottom and a top, the base having a longitudinally extending body with first and second longitudinal ends, a slot extending upward from the bottom toward the top and terminating spaced from the top and extending through the first and second ends for receiving a rolled seam of a metal roof in the slot, the slot dividing the base into first and second opposite sides connected at the top, said first side having holes extending transversely through the side for receiving and holding anchor screws, a snow brake plate connected to the base and extending laterally beyond the opposite sides of the base and extending upward to beyond the top of the base and having lateral portions extending outward from the opposite sides of the base near one end of the base and near a bottom of the plate, wherein further said second opposite side defines a ridge to protrude below said rolled seam to prevent removal of said snow brake from said seam when said anchor screws are engaged.

* * * * *